United States Patent [19]

Thomas

[11] Patent Number: 4,862,147

[45] Date of Patent: Aug. 29, 1989

[54] SMOKE ALARM WITH DROPOUT SMOKE HOOD

[75] Inventor: Byron E. Thomas, Placentia, Calif.

[73] Assignee: Puritan-Bennett Aero Systems Company, Lenexa, Kans.

[21] Appl. No.: 769,394

[22] Filed: Aug. 26, 1985

[51] Int. Cl.[4] ..... G08B 17/10

[52] U.S. Cl. ..... 340/628; 340/572; 128/201.23

[58] Field of Search ..... 340/628, 692, 629, 630, 340/573; 128/201.25, 202.13, 202.26, 202.27; 250/381; 236/49

[56] References Cited

U.S. PATENT DOCUMENTS

| | | | |
|---|---|---|---|
| 2,436,249 | 2/1948 | Clement | 128/201.25 |
| 3,503,394 | 3/1970 | Hotz et al. | 128/206.27 |
| 3,536,070 | 10/1970 | Bovard | 128/202.26 |
| 3,565,068 | 2/1971 | Bickford | 128/201.25 |
| 3,789,839 | 2/1974 | Lund et al. | 128/201.25 |
| 3,934,145 | 1/1976 | Dobrzanski et al. | 250/381 |
| 4,032,991 | 7/1977 | Vandeweghe | 128/201.25 |
| 4,117,461 | 9/1978 | Kiebala | 340/692 X |
| 4,154,235 | 5/1979 | Warncke | 128/201.25 |
| 4,154,237 | 5/1979 | Courter | 128/206.27 |
| 4,257,039 | 3/1981 | Webb et al. | 340/629 |
| 4,331,139 | 5/1982 | Pupa | 128/202.13 |
| 4,335,379 | 6/1982 | Martin | 340/692 X |
| 4,382,440 | 5/1983 | Kapp et al. | 128/201.25 |
| 4,463,896 | 8/1984 | Schaus | 236/49 |
| 4,467,795 | 8/1984 | Eckstein | 128/201.25 |
| 4,481,945 | 11/1984 | Levine | 128/206.27 |
| 4,710,756 | 12/1987 | Thornburg et al. | 340/573 X |

*Primary Examiner*—Joseph A. Orsino
*Assistant Examiner*—Jeffery A. Hofsass
*Attorney, Agent, or Firm*—Hovey, Williams, Timmons & Collins

[57] ABSTRACT

A smoke or other type of hazard alarm with drop-out protective hood or the like is provided which serves automatically upon detecting smoke to drop a tethered personal smoke protective hood or mask to a convenient height for user access. The preferred embodiment includes a housing containing a smoke detector, a compartment in which the hood is stored, a hinged and normally latched door closing the compartment, and a solenoid which is energized by the smoke detector for unlatching the door. When smoke is detected, the detector sounds an alarm and energizes the solenoid which unlatches the door allowing it to swing open, thereby permitting the hood to drop to a level predetermined by the length of the tether. Thus hood is accessible by the user who then removes the hood, puts it on, and is thereby protected from smoke inhalation during escape to a safe place. The smoke detector can also activate a prerecorded verbal emergency message played by a unit contained within the housing.

8 Claims, 1 Drawing Sheet

Fig.3.
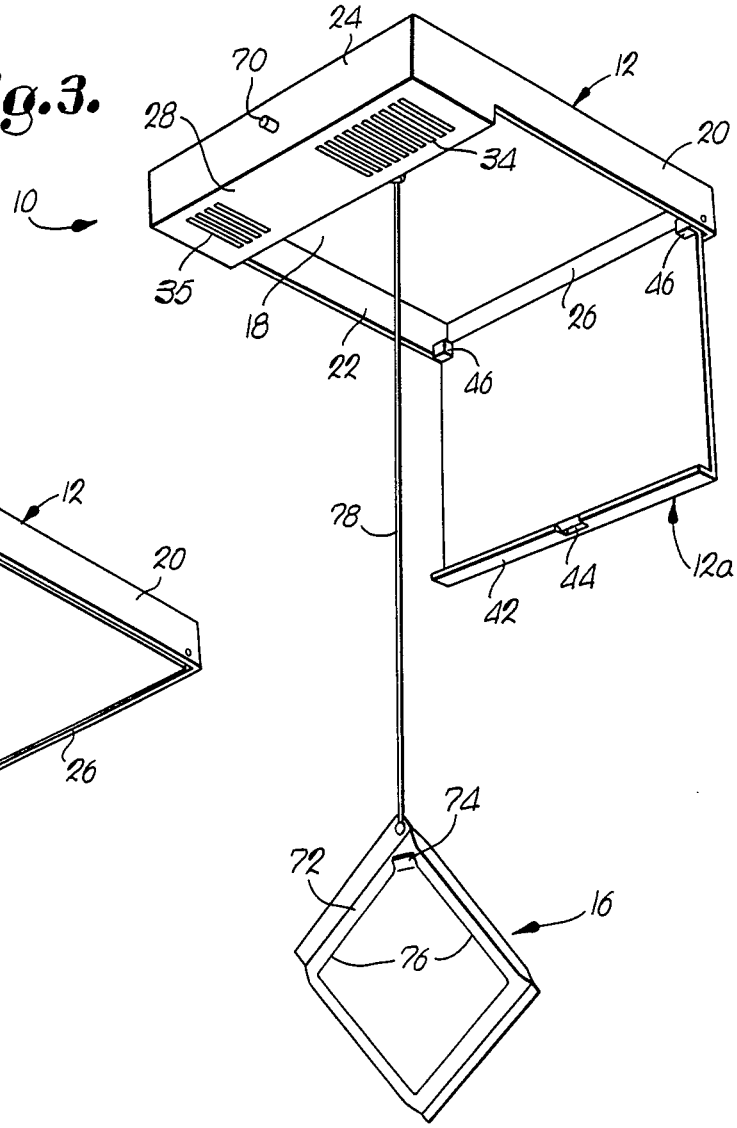
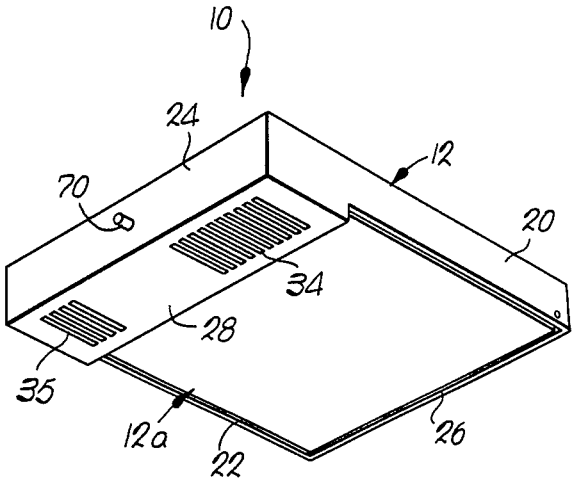
Fig.2.
Fig.1.
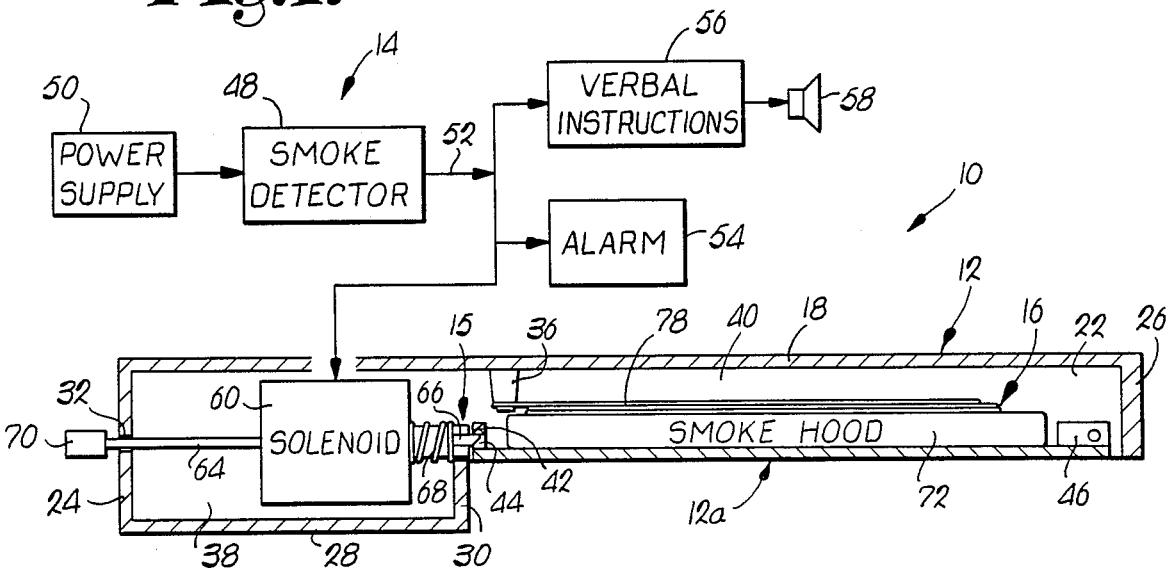

SMOKE ALARM WITH DROPOUT SMOKE HOOD

BACKGROUND OF THE INVENTION

1. Field of the Invention

This invention broadly pertains to an improved smoke detector or other hazard detector and a personal protective hood or mask automatically releasable in the event of hazard detection. More particularly this invention relates to a smoke detector coupled to a personal protective hood or hoods which is automatically releasable when smoke is detected so that an escape can be made without being overcome by smoke.

2. Description of the Prior Art

In the event of a fire, smoke inhalation is one of the greatest dangers to human life. Existing known smoke detectors such as those disclosed in U.S. Pat. Nos. 3,934,145 and 4,257,039 sense the presence of smoke in the air and an emit an audible alarm. These smoke detectors however do not provide any means to protect humans from smoke inhalation.

Personal protective devices such as those disclosed in U.S. Pat. Nos. 4,331,139, 4,467,795, 4,032,991, 3,789,839, 4,324,440, 2,436,249, 3,565,068, and 4,154,235 do provide a means of protection against smoke inhalation, but these devices have limited utility in the event of a sudden fire, especially in locations where escape will require more than a few seconds. Thus, a potential user may not know of the devices' existence, may not be able to find the device because of smoke impaired vision, or may not have time to go to the devices' location. Moreover, some of these prior devices are not even portable.

Airline oxygen mask systems such as those disclosed in U.S. Pat. Nos. 3,503,394 and 3,536,070 are also known, but these provides no corresponding alarm function. Further, the generation of oxygen by these systems provides a degree of protection in aircraft at high altitudes, but no protection from smoke conditions.

SUMMARY OF THE INVENTION

The problems outlined above are in large measure solved by the smoke protection system in accordance with the present invention. Broadly speaking, the present invention includes a hazard detector for detecting smoke or the like, a protective hood or mask for use by a person to permit normal breathing under hazardous ambient conditions, means releasably attaching the hood in a storage position (e.g., adjacent a ceiling, wall or the like), and means operably coupling the detector with the hood attachment means so that upon detection of an ambient hazard the hood is released for convenient user access.

More particularly, the overall protection system advantageously includes a housing having walls defining a compartment therein, a tethered smoke protective hood located within the compartment for use by a person to permit normal breathing under hazardous ambient conditions, and a door or similar retaining means hingedly mounted to the housing for normally closing the hood compartment. A door latch is also provided for retaining the door in a normally closing relationship with the compartment. The latching mechanism is operated by means of a solenoid located within the housing which includes an elongated axially reciprocable plunger and a door latching element attached to one end of the plunger. The remaining end of the plunger extends out of the housing and is accessible for manual movement to selectively delatch the latching element. The smoke detector itself is of conventional design and operates using an external electrical power source, or an internal power supply such as batteries. An electrically operated horn or alarm is included in the device. The output signal of the detector is coupled in parallel with the latching solenoid and, if desired, an escape light and/or a device for giving verbal instructions for use of the hood and/or escape directions. An override circuit may also be included to activate the alarm and instructions and dispense protective hoods. The override could be activated from a remote location (e.g., a hotel/motel office) for the purpose of warning and evacuating people prior to the spread of fire and smoke to their area. In addition, a power indicator light would normally be provided to ensure that the internal power supply is still functional.

In operation, when smoke is detected, the smoke detector sounds an audible alarm and by means of the output signal energizes the solenoid. The solenoid then causes the plunger to retract the latching element, thereby delatching the door. The door then swings open under the influence of gravity (or by spring force if desired) and the tethered smoke hood then drops down to a level predetermined by the length of the tether. The user then has ready access to a smoke protective hood or mask, the location of which is identified by the audible alarm whether or not the existence of the protective hood was previously known. The hood hanging by the tether also provides a visual signal to the user of its presence. The user then removes and dons the protective hood and is thereby protected from possibly fatal smoke inhalation while escaping to a safe place.

BRIEF DESCRIPTION OF THE DRAWING

FIG. 1 is a partially schematic, partial cross-sectional view of a preferred device in accordance with the invention;

FIG. 2 is a perspective view of the device depicted in FIG. 1 and illustrates the housing with hood door in its normally closed position; and FIG. 3 is a view similar to that of FIG. 2, but illustrating the door open position with the smoke hood in its cover dangling by the tether from the housing.

DESCRIPTION OF THE PREFERRED EMBODIMENT

Turning now to the drawings, a protective device 10 in accordance with the invention broadly includes a housing 12 adapted for connection to a wall or ceiling and having a hingedly mounted access door 12*a*, a smoke detector device 14 situated within housing 12, door latching mechanism 15, and a drop-out protective smoke hood 16 likewise normally positioned within the housing 12.

In more detail, the housing 12 is of substantially integral construction and is preferably formed of rigid synthetic resin material or metal. The housing 12 is generally rectangular in plan configuration, and includes a top wall 18, spaced, depending sidewalls 20, 22, end walls 24, 26, bottom wall 28 and intermediate connecting wall 30. End wall 24 is apertured as at 32 for purposes which will be explained, whereas bottom wall 28 is provided with two series of louvers 34, 35. A depending connecting stud 36 is affixed to top wall 18 (see FIG. 1).

Referring specifically to FIG. 1, it will be seen that the walls 20–24, 28 and 30, as well as the left-hand portion of top wall 18, cooperatively define an elongated, rectangular compartment 38 designed to receive the components of the device 14 and door latching mechanism 15. Also, a smoke hood compartment 40 is defined between the right-hand section of top wall 18, door 12*a*, and walls 20, 22, 26 and 30.

The door 12*a* is essentially rectangular in plan configuration, and includes, adjacent the left-hand edge thereof as viewed in FIG. 1, an upstanding connection wall 42 which is centrally apertured as at 44. The door 12*a* is hingedly connected to the sidewalls 20, 22 by means of conventional hinges 46.

The smoke detector device 14 is of conventional construction and includes the usual smoke detector 48 together with a power supply 50, such as a battery, operatively coupled thereto. The output of detector 48 is coupled through appropriate circuitry 52 to an audible alarm 54. In like manner, a play-back unit 56 and speaker 58 may also be operatively coupled via the circuit 52 to the output of detector 48.

As indicated, detector 48, battery 50, circuitry 52, alarm 54, play-back unit 56 and speaker 58 are located within the compartment 38. The detector 48 is adjacent the smoke inlet louvers 35, whereas alarm 54 and speaker 58 are situated adjacent the louvers 34, so as to ensure the maximum broadcast effect.

Latching mechanism 15 includes a conventional solenoid 60 which is operatively connected by means of circuitry 52 to the output of detector 48. As seen in FIG. 1, solenoid 60 is likewise situated within compartment 38. An elongated, axially reciprocable plunger 64 forms a part of the overall solenoid 60. The right-hand end of plunger 64 includes a latching element 66 as well as a surrounding coil spring 68 which biases the plunger 64 in a rightward, latching direction as viewed in FIG. 1 so that the element 66 extends into aperture 44 to hold door 12*a* in its closed position. The remaining end of plunger 64 extends leftwardly as seen in FIG. 1 through the aperture 32 provided in sidewall 24. An enlarged knob 70 is provided adjacent the outermost end of the plunger rod as illustrated, so as to permit manual reciprocation of the rod and delatching of door 12 in the manner to be explained.

The hood 16 is of normal design and is advantageously encased within a pliable synthetic resin envelope 72. Envelope 72 is provided with a pull tab 74 and appropriate lines of weakness 76 in order to facilitate opening of the envelope and access to smoke hood therewithin. The envelope 72 carrying the smoke hood is secured within housing 12 by means of an elongated string-like tether 78. In this regrad, it will be seen that one end of the tether 78 is secured to stud 36, whereas the remaining end thereof is affixed to envelope 72.

In the use of device 10, the unit is conveniently mounted in an area to be protected, such as a hotel room or bedroom. In this regard, the unit would typically be mounted to a ceiling or a wall adjacent the ceiling; such connection is normally effected by means of conventional bolts or the like passing through top wall 18.

In the standby mode, the device 10 is provided with a battery as power supply 50, and moreover the hood 16 is in its stowed position within compartment 40, with door 12*a* being closed (see FIG. 1).

In the event of a fire, smoke in the ambient air passes through the inlet louvers 35, whereupon such smoke is detected by means of the detector 48. At this point, an output signal is generated by the detector 48, so as to simultaneously energize alarm 54 and solenoid 60 via circuitry 52. This creates an audible alarm (e.g., a horn or klaxon) in order to warn inhabitants in the area to be protected. At the same time, energization of the solenoid 60 serves to retract plunger rod 64 leftwardly as viewed in FIG. 1, with the effect that latching element 66 is withdrawn from aperture 4 of door 12*a*. When this occurs, door 12*a* drops downward under the influence of gravity, as illustrated in FIG. 3 (as indicated, a spring loaded mechanism could be provided for opening door 12*a*). Opening of the door 12*a* in turn permits tethered hood 16 to drop to a convenient user access height, so that an occupant of the area to be protected can readily open envelope 72 and don the hood therewithin. As explained, the user simply grasps the envelope 72 and pulls the tab 74 in order to open the envelope and have ready access to the hood. Once the hood has been removed from envelope 72, it can be placed over the face or head of the user as the case may be, so that the person can breathe normally while escaping from the area.

In those instances wherein device 10 is provided with a playback unit 56 and speaker 58, the unit 56 is likewise simultaneously activated along with alarm 54 and solenoid 60 via circuitry 52. Typically, the playback unit 56 and speaker 58 would broadcast instructions for use of the smoke hood 16 and/or instructions about the most expeditious escape routes from the area or building. Also, a light could be used which would likewise be activated with the other components.

As can be appreciated, unit 10 would require normal periodic servicing and checking of hood 16. To this end, when such normal maintenance is required, it is only necessary to grasp the knob 70 and manually pull plunger rod 64 leftwardly as viewed in FIG. 1 against the bias of spring 68. This serves to retract latching element 66 from aperture 44, whereupon door 12*a* pivots downwardly and smoke hood 16 drops from the compartment 40. After the hood 16 is checked or replaced as necessary, the tether 78 is recoiled and hood 16 replaced within compartment 40. The door 12*a* can then be closed in the usual fashion, so that the overall device 10 is again ready for emergency use.

We claim:

1. A protection system for use in a room or the like in order to afford a person a means of safe breathing and escape from the room in the event of smoke or other hazard therein, said system comprising:

a housing including walls defining a compartment therein, shiftable door means normally closing the compartment, and releasable latch means for normally retaining the door means in the compartment-closing position thereof, and for selective opening of the door means upon release of the latch means;

means for detecting a hazard within said room, and for generating an output signal in response to such detection;

means operably coupling said detecting means and said latch means for releasing the latch means and opening of said door means in response to said output signal; and a self-contained portable protective device of the type to be used by said person and be operable when completely separate from said housing so as to permit safe breathing by the person and escape of the person from said room, said protective device being normally releasably retained within said housing compartment, said device being deployable upon opening of said door means for ready access to the device by said person, and being completely detachable from the housing for allowing the person to use the device and also move freely and independently away from said housing and thereby escape from said room.

2. The protective system as defined in claim 1, said detecting means including means for detecting smoke.

3. The protection system as defined in claim 1, including elongated string means for detachably tethering said device to said housing.

4. The protection system as defined in claim 1, wherein said detecting means is located within said housing.

5. The protection system as defined in claim 1, said compartment including means playing a pre-recorded verbal message in response to said output signal.

6. The protection system as defined in claim 1, including a solenoid actuatable in response to said output signal, said solenoid being operably coupled to said latching means for release of the latching means.

7. The protection system as defined in claim 6, said solenoid being located within said housing and said solenoid including an elongated, axially reciprocal plunger, said latching means comprising a latching element secured to one end of said plunger, the other end of said plunger extending out of said housing, said other end of said plunger being accessible for manual movement of said plunger in order to selectively release said latch means.

8. The protection system as defined in claim 1, further comprising an alarm means actuated in response to said output signal.

* * * * *